United States Patent [19]

Bazell

[11] 4,124,495

[45] Nov. 7, 1978

[54] PROCESSING OF CRUDE OILS

[75] Inventor: Graydon C. Bazell, Poughkeepsie, N.Y.

[73] Assignee: The de Laval Separator Company, Poughkeepsie, N.Y.

[21] Appl. No.: 772,853

[22] Filed: Feb. 28, 1977

[51] Int. Cl.[2] ..... C10G 17/00

[52] U.S. Cl. ..... 208/251 R; 208/370

[58] Field of Search ..... 208/37, 38, 251 R, 370, 208/46

[56] References Cited

U.S. PATENT DOCUMENTS

| | | | |
|---|---|---|---|
| 2,100,662 | 11/1937 | Lyman et al. | 208/37 |
| 2,411,492 | 11/1946 | Wingrove | 208/251 R |
| 3,038,854 | 6/1962 | Kiersted | 208/38 |
| 3,684,686 | 8/1972 | Herbstman et al. | 208/37 |
| 4,012,314 | 3/1977 | Goldberger et al. | 208/251 R |

OTHER PUBLICATIONS

Chemical Constituents of Petroleum by Sachanen, 302–306, (1945).

The Institute of Petroleum, 49, No. 477, 259–272, (1963).

*Primary Examiner*—Delbert E. Gantz

*Assistant Examiner*—Joseph A. Boska

*Attorney, Agent, or Firm*—Cyrus S. Hapgood

[57] ABSTRACT

A stream of wax-containing crude oil is passed through a heating zone which heats it sufficiently to melt the wax and is then passed through a rapid cooling zone where it is cooled to a temperature below the freezing point of the wax but sufficiently rapdily to prevent solidification of the wax. The cooled oil is then subjected promptly to further treatment while the wax is still in liquid condition in the oil at a temperature below said freezing point. The further treatment preferably includes passing a mixture of the cooled oil and wash water through a centrifuge and there separating the wash water from the oil while retaining the wax in the washed oil discharged from the centrifuge.

3 Claims, 1 Drawing Figure

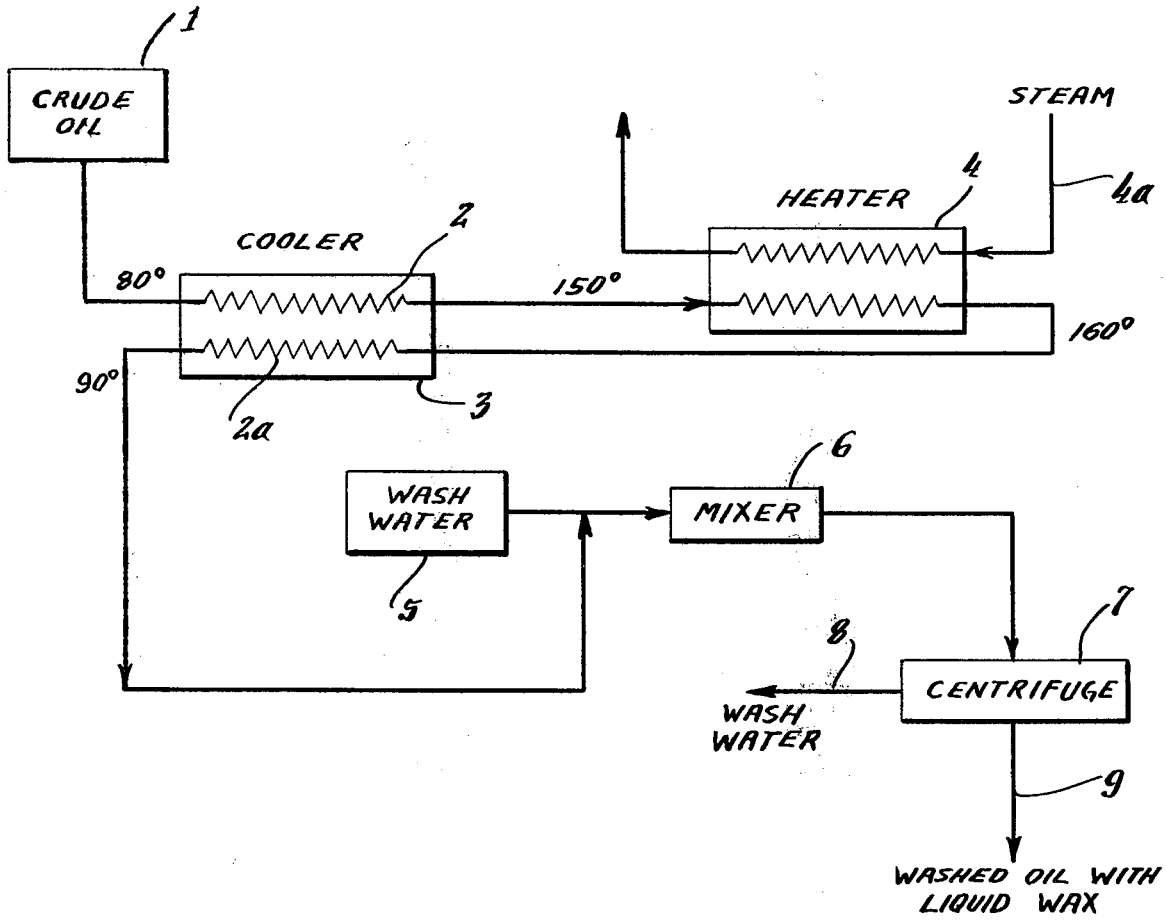
1
CRUDE OIL
STEAM
4
4a
HEATER
COOLER
2
80°
150°
160°
90°
2a
3
6
WASH WATER
MIXER
5
7
8
CENTRIFUGE
WASH WATER
9
WASHED OIL WITH LIQUID WAX

PROCESSING OF CRUDE OILS

This invention relates to the processing of crude oils and more particularly to an improved process for treating crude oils while they retain their wax content in liquid form at temperatures below the freezing point of the wax.

The processing of wax-bearing crude oils is usually aimed at removing the wax from the oil. Such removal is generally effected by heating the oil sufficiently to melt its wax content and then cooling the oil so as to cause precipitation of the melted wax into crystals which can be readily separated from the oil.

There are occasions when it is desirable to retain the wax in the crude oil while the oil is being treated at a temperature below the freezing point of the wax. However, when the wax is frozen (i.e., in a solid state), it tends to separate from the oil during most treatments, so that it cannot be retained in the oil.

An example of such an occasion is the washing of crude oil by centrifuging it in the presence of wash water. It is not practical to effect the centrifuging while the oil is at a temperature high enough to keep the wax in liquid condition, because this would result in an excessive amount of vapors at the entrance into the tubular shaft (inlet) of the centrifuge, where the pressure is at a minimum in the system and a slight vacuum usually prevails. These excessive vapors would make it difficult if not impossible to control the system. On the other hand, if the oil is centrifuged at a low temperature with the wax in precipitated or crystalline form, the wax will settle in the centrifuge and soon impair its operation, requiring discharge of the centrifuge at frequent intervals. Moreover, if the washed oil is to be used as a fuel, as in gas turbine engines, it is a disadvantage to remove the wax because the latter is an excellent fuel.

An object of the present invention is to provide a method of treating crude oil at a temperature below the freezing point of the wax without causing the latter to clog or otherwise impair the centrifuge or other equipment used in the treatment.

In a method according to the invention, a stream of wax-bearing crude oil is passed through a heating zone where it is heated to a first temperature sufficiently high to liquefy the wax, after which the heated oil is passed through a rapid cooling zone where it is cooled to a second temperature below the freezing point of the wax. However, this cooling of the oil is effected sufficiently rapidly to prevent immediate solidification of the wax, whereby the wax content of the oil is maintained in a liquid condition substantially free of crystals for a time period sufficient to subject the cooled oil to further treatment at about said second temperature. This time period may be in the order of 9 minutes.

The new method may be used to particular advantage in the desalting of crude oil by centrifuging it in the presence of wash water, so that the oil can be used as a gas turbine fuel. Accordingly, the invention will now be described more fully in connection with this use, although it will be understood that the invention is not limited thereto.

In the following detailed description, reference is made to the accompanying drawing, in which the single illustration is a schematic view of a system suitable for desalting crude oil in accordance with the invention.

Referring to the drawing, a stream of wax-bearing crude oil from a supply tank 1 is preheated by passing it through the heating section 2 of a heat exchanger 3. The oil then passes through heater 4 where it is heated to a temperature sufficient to melt the wax, for example, 150° to 160° F. The oil from heater 4 passes through a rapid cooling zone formed by section 2*a* of heat exchanger 3, where it is cooled to a temperature well below the freezing point of the wax, for example, a temperature of 80° to 90° F. The cooler 3, which is preferably a plate heat exchanger, is adapted to cool the oil sufficiently quickly to retain the wax in liquid condition. The quick-chilled oil from cooler 3 is combined with a stream of wash water from a supply source 5 and then passed through a mixer 6 to a centrifuge 7, still at a temperature of about 80° to 90° F. Centrifuge 7 is of any conventional type adapted to separate an oil-water mixture and continuously discharge the two separated components. The wash water is discharged from the centrifuge at 8, and the washed oil with the liquid wax is discharged at 9.

The heater 4 may be a plate heat exchanger to which steam is supplied as a heating medium, as shown at 4*a*. Of course,the system is provided with any suitable pumping means (not shown) to effect the flow as described above.

Eventually, the wax in the washed oil from centrifuge 7 will precipitate, in the absence of some special measure to prevent this. However, due to the rapid chilling of the oil in cooler 3, the wax will precipitate in a very small crystalline state so that it is difficult to separate from the oil. Thus, the oil can be subjected to further operations without substantial settling of the wax.

It will be understood that the particular temperature to which the crude oil must be heated in zone 4, in order to melt its wax content, will depend upon the source of the crude oil (the particular composition of the wax). Also, the optimum temperature for centrifuging the oil, to separate the wash water while retaining the wax in the oil, will vary from crude to crude.

The rate at which the oil is chilled in the cooler 3, to prevent the wax from immediately solidifying, will depend upon the particular composition of the wax, but in general the rate must be at least about 140° F. per minute.

EXAMPLE

A crude oil from Saudi Arabia and having a wax content of 2.5% by weight is pumped at a rate of 200 gallons per minute through heat exchanger 3, which preheats the oil from 80° to 150° F. The oil then passes to heater 4 where it is heated to a temperature of 160° F., so that all the wax is melted. In passing through cooling zone 2*a*, the oil is then chilled to 90° F. at a rate of 140° F. per minute. The chilled oil passing to mixer 6 is mixed with wash water from source 5 in a ratio of one part of water to 20 parts of oil by weight. From mixer 6, the mixture at a temperature of 90° F. passes to centrifuge 7 which is De Laval's MAPX 313 OIL PURIFIER. The washed oil discharged at 9 contains essentially all of its original wax content and is suitable for use in fueling gas turbine engines.

I claim:

1. In the processing of a wax-containing crude oil, the method comprising the steps of passing a stream of the crude oil through a heating zone and there heating the oil to a first temperature sufficiently high to melt the wax therein, passing the heated oil through a rapid cooling zone and there cooling the oil to a second temperature below the freezing point of the wax but sufficiently rapidly to prevent immediate solidification of the wax, whereby the wax remains temporarily in a liquid condition substantially free of crystals, and then subjecting the cooled oil to centrifugal separation while the wax is still in a liquid condition in the oil at about said second temperature.

2. The method of claim 1, in which said first temperature is at least about 150° F., said second temperature being in the range of about 80° to 90° F.

3. The method of claim 1, in which said cooling is effected at a rate of at least about 140° F. per minute.

* * * * *